US006034582A

United States Patent [19]

Fausch

[11] Patent Number: 6,034,582

[45] Date of Patent: Mar. 7, 2000

[54] RELAY

[75] Inventor: Werner Fausch, Buchs, Switzerland

[73] Assignee: Elesta Relays GmbH, Bad Ragaz, Switzerland

[21] Appl. No.: 09/249,049

[22] Filed: Feb. 12, 1999

[30] Foreign Application Priority Data

Feb. 18, 1998 [EP] European Pat. Off. ..... 98 81 0132

[51] Int. Cl.[7] ..... H01H 51/22

[52] U.S. Cl. ..... 335/78; 335/128; 335/129; 335/131; 335/202

[58] Field of Search ..... 335/78–86, 124, 335/128, 129, 130, 131, 202

[56] References Cited

U.S. PATENT DOCUMENTS

| | | | |
|---|---|---|---|
| 4,405,911 | 9/1983 | Hasegawa et al. . | |
| 4,709,219 | 11/1987 | Nestlen et al. . | |
| 5,243,312 | 9/1993 | Schedele . | |
| 5,250,919 | 10/1993 | Schedele . | |
| 5,568,108 | 10/1996 | Kirsch | 335/130 |
| 5,805,040 | 9/1998 | Corcoran | 335/202 |
| 5,864,270 | 1/1999 | Hoffmann | 335/78 |

FOREIGN PATENT DOCUMENTS

| | | |
|---|---|---|
| 0049088 | 4/1982 | European Pat. Off. . |
| 0133977 | 3/1985 | European Pat. Off. . |
| 0331134 | 9/1989 | European Pat. Off. . |
| 19621557 | 1/1997 | Germany . |
| 19627208 | 10/1997 | Germany . |
| 9107769 | 5/1991 | WIPO . |

*Primary Examiner*—Lincoln Donovan
*Assistant Examiner*—Tuyen T. Nguyen
*Attorney, Agent, or Firm*—Burns, Doane, Swecker & Mathis, LLP

[57] ABSTRACT

In connection with a relay with contact units on both sides of a partition and with plug connectors which can be plugged vertically in relation to the partition, a very compact construction is achieved by offsetting the contact units arranged on the top side of the partition with respect to the contact units arranged on the bottom side, and by passing the plug connectors through the partition and between the electrically conductive elements arranged on the bottom side. Thanks to offsetting the plug connectors with the connecting element on the centerline (M), a very large distance can be achieved between the plug connectors, which meets all minimal requirements for a safe separation of different potentials. Labyrinthine courses for air and leakage paths between the circuit units and with respect to the actuating member can be created it the interior in the relay by the partition, separating walls, covers and collars, which also meet these requirements.

12 Claims, 6 Drawing Sheets

RELAY

BACKGROUND OF THE INVENTION

1. Field of the Invention

The present invention relates to a relay with at least two contact units, which are separated by an insulating partition, wherein each contact unit has at least two contact members, at least one of which is an elongated contact spring oriented parallel with the partition, whose contact end is movable parallel with the partition for making or breaking a contact, having an actuating member for moving the contact ends and plug connectors for connecting the relay, which plug connectors can be plugged in a vertical direction in respect to the partition.

2. State of the Art

Such relays are to be plugged horizontally in a board, since the plug connectors can be plugged in the direction of the smallest dimension of the relay. There is a demand for horizontal relays, because relays are among the largest elements to b arranged on a board. So that the boards can now be arranged as closely together as possible, it is desired that relays have the lowest possible structural height, i.e. project as little as possible away from the board. Moreover, boards are preferred which take up as little space as possible.

The usual manner of designing a horizontal relay consists in bending the plug connectors of an upright relay, which project out of the housing as extensions of the contact springs, by 90° outside of the housing, wherein the contact units on the one side of the partition are conducted around the other plug connectors. This arrangement requires additional room for the size of the spaces between the plug connectors. In this case it is also disadvantageous that it is possible to make a connection between the board, into which the relay is plugged, and the relay only on one side of the latter. Forces acting ton the relay in case of jarring act with an accordingly large leverage.

SUMMARY OF THE INVENTION

It is therefore the object of the invention to create a relay of the species mentioned at the outset, which is as small as possible. In addition, it should meet the standards for air and leakage paths for a dependable separation between the contact units, or respectively between the current-carrying elements of different potential. The relay should also be usable in cases where a so-called minimum safety voltage must be insulated form the network voltage potential.

This is attained in accordance with the invention in that the plug connectors of the contact members on one side of the partition are arranged at the contact end located opposite the contact springs, and the plug connectors of the contact members on the other side of the partition are offset from the first plug connectors toward the contact end, preferably at approximately half the length of the contact springs, and are arranged in the direction of movement of the contact springs at a distance from the contact springs, and/or that the connecting elements from the contact members on the one side of the partition to the associated plug connectors on the other side of the partition are conducted through the partition.

Because the connecting elements are conducted through the partition, passing around the partition and claiming the required additional space are avoided. Therefore the plug connectors occupy the space which is needed for the relay anyway. By means of offsetting the plug connectors on this side of the partition in a direction parallel with the contact springs in relation to the plug connectors on the other side of the partition, a distance between the plug connectors has been provided which easily meets the minimum requirements regarding leakage and air paths. Moreover, the connection between the relay and the board is less sensitive to jarring, thanks to the relatively large distance between the plug connectors. Also, smaller bending forces act on the plug connectors, since they are arranged less eccentrically. In addition, the plug connectors offset toward the center occupy the space needed for the relay anyway, so that no additional space requirements are needed for the plug connectors.

An embodiment of a relay having both features is preferred, since its plug connectors fall within the dimensions of the relay determined by the length of the contact springs, and at the same time the distances between the plug connectors can easily be made sufficiently large, so that a spacing of 10 mm for assured separation is maintained.

In order to prevent a conflict between the connection elements passed through the partition and the electrically conductive elements on the other side of the partition, the connecting elements passed through the partition from the contact members on the one side of the partition to the associated plug connectors on the other side of the partition are passed through between the contact members arranged on the other side of the partition and/or the electrically conductive elements, which are in contact with the latter.

If the contact units on this side and the other side of the partition are placed exactly opposite each other, this can be achieved in that the connecting elements are designed in the shape of a letter Z and have such an offset, that they pass exactly between the electrically conductive elements on the plug connection side of the partition. So that the connecting element can be pushed into the support element, or respectively through the partition, and is held in a clamping groove from the direction of both sides, however, it is preferred that the contact unit on one side of the partition is arranged in respect to the contact unit on the other side of the partition parallel with the partition and offset approximately vertically in respect to the length of the contact springs, and that the connecting element has a flat surface. With this offset arrangement of the contact units, the very simply designed connecting elements can be passed through the partition on the level of the contact springs in order to pass between the electrically conductive elements of the contact units on the plug connector side.

In an advantageous manner the plug connectors, which are arranged on the oppositely located end of the contact springs, are passed through the partition. The opposite is also possible, namely that the connecting elements passed through the partition are conducted approximately on a center level extending vertically in relation to the contact springs through the partition between the electrically conductive elements and finally through the housing, and that the other plug connectors on the plug connector side merely directly exit from the housing at the end of the contact spring located opposite the contact end. But since the contact springs are movable, there is less space available between them for passing the connecting elements through and insulating them with increasing distance of the contact springs from their ends fastened opposite the movable contact end. For this reason the claimed passage of the connecting elements near the fixed end is preferable for a compact construction.

If the relay housing consists of a cover an a bottom element, which enclose the contact units, the partition and the actuating member, wherein the bottom of the bottom element is arranged parallel with the partition and has openings for the plug connectors, the connecting elements passed through the partition are respectively advantageously surrounded at least partially near the bottom of the partition by a collar connected with the partition and a collar connected with the bottom element. In this case, one collar is suitably arranged around the other, so that leakage and air paths between the elements connected with the contact members of the one side and elements connected with the contact members of the other side have at least a minimal value fixed by the standards. The inner collar is suitably arranged on the same element on which the contact units on the plug connector side are fastened. If the contact units on the plug connector side are fastened on the bottom element, the inner collar is advantageously arranged on the bottom element, but if all contact units are arranged on the partition, it is arranged on the partition.

If the contact springs are in engagement with a slide or a cradle which can be moved by means of the actuating member, the slide advantageously has two elongated small plates, separated by a slit and arranged on the same level on a strip. These small plates are in contact with the extreme ends of the contact springs, and the strip is in contact with the actuating member. The small plates can have slits for all variations of circuit arrangements of the contact units if the contact springs to be moved are embodied to be slightly longer than the other contact springs. The partition is arranged vertically in respect to the small plates in the slit between them, and a cover, T-shaped in cross section, is arranged with a transverse face parallel with the small plates between the latter and the housing and has been inserted with a cradle being vertical in respect to the transverse face in a groove in the partition, so that the small plates are maintained in their position in which they are engaged with the contact springs and wherein moreover the air and leakage path between the contact units separated by the partition has at least a defined size. This allows a very simple assembly of the contact units on the partition. The contact springs are also guided with the greatest possible lever effect, so that only small forces are necessary for moving the springs.

If the actuating member is constituted by an electromagnet with a coil around a core, respectively one plug connector of the coil, which can be plugged vertically in respect to the partion, is advantageously arranged at the two ends of the coil. Because of this, these plug connectors are as far as possible apart from each other, so that the relay can be connected with a board on a wide base surface, which is resistant to jarring.

The contact units on both sides of the partition are advantageously fastened on the partition or on a support element constituting the partition. By means of this the interior of the relay can be combined into one component with high precision and merely needs to be protected by the housing. This applies even more so, if the actuating member can be plugged into this support element.

If the actuating member is constituted by an electromagnet with a tilting armature, whose core is aligned approximately parallel with the contact springs, the tilt axis of the tilting armature is advantageously arranged at that pole which is located opposite the pole close to the movable contact ends of the contact springs. Because of this, the lever of the tilting armature moving the contact springs by means of a slide has the entire length of the magnetic core available, if necessary. Therefore the lever of the tilting armature attracted, or respectively released, by the core can have a short path, for which a reduced magnetic force is needed. Therefore the magnet can be of a smaller size. Moreover, the corresponding dimension of the relay housing is only determined by the length of the contact springs. The coil and the lever of the tilting armature moving the contact springs do not require an additional extension of the housing beyond the seize determined by the contact springs.

An exemplary embodiment of the invention will be descried in what follows, making reference to the drawings.

BRIEF DESCRIPTION OFT HE DRAWINGS

The forgoing and other features of the present invention will become apparent to those skilled in the art upon reading the following description of preferred embodiments of the invention in conjunction with the accompanying drawings, wherein like elements have been designated by like reference numerals, and wherein:

FIG. 1 is a representation, partially in section, of a view on the top of an exemplary relay, FIG. 2 is a view of the relay from below, wherein the bottom has been cut off, FIG. 3 is a plan view of the bottom from the interior, FIG. 4 is a cross-sectional view of the bottom along the line I—I in FIG. 3, FIG. 5 is a cross-sectional view of the bottom along the line II—II in FIGS. 1 and 2, FIG. 6 is a cross-sectional view of the bottom along the line III—III in FIGS. 1 and 2, FIG. 7 is a cross section through an exemplary relay wherein no connecting element is passed through the partition, FIG. 8 is a cross section through an exemplary relay wherein the connecting elements passed through the partition are Z-shaped, and FIG. 9 shows an exemplary relay, wherein the connecting elements to the plug connectors, which are offset toward the center, are passed through the partition.

DETAILED DESCRIPTION OF THE PREFERRED EMBODIMENTS

Figure 1:
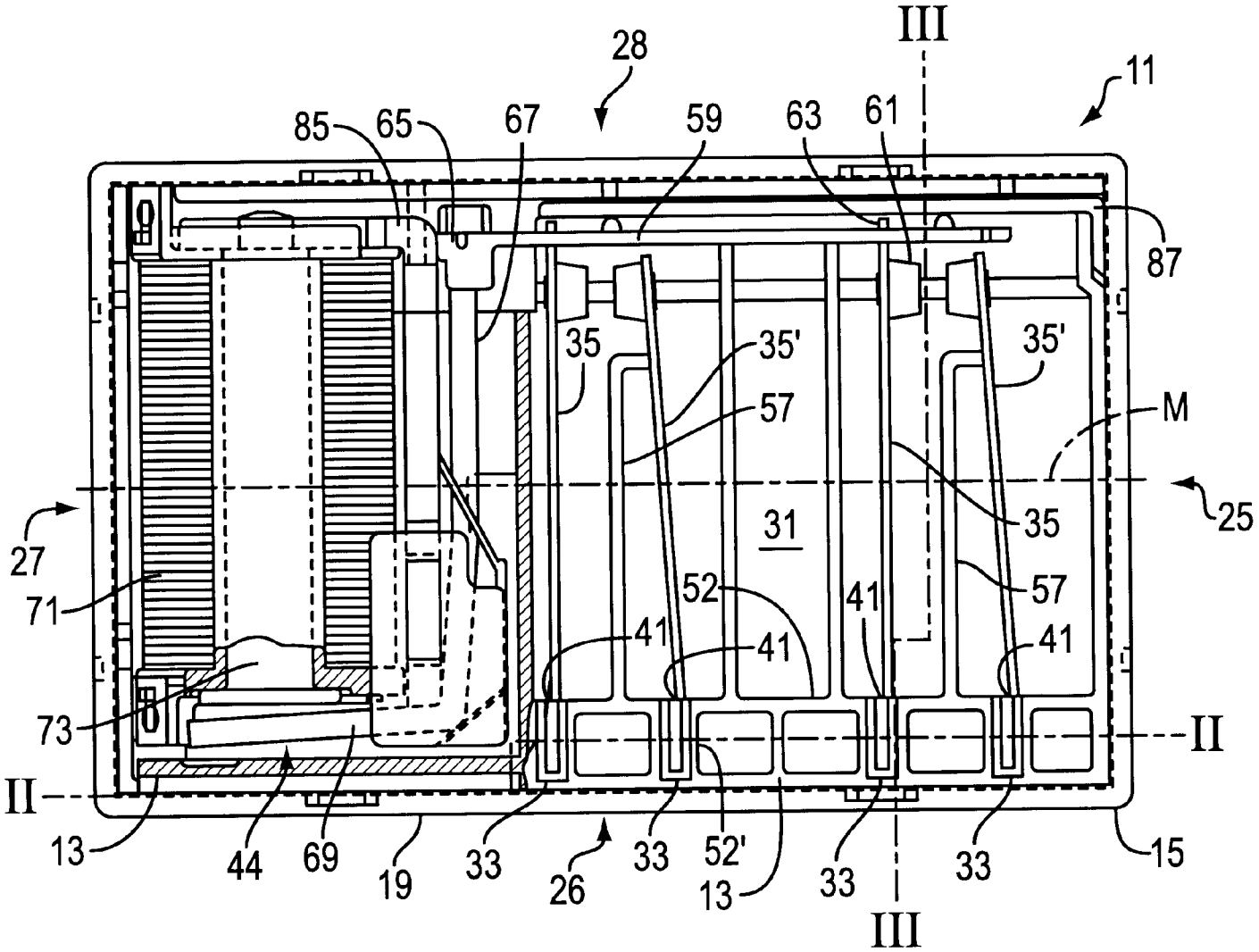
Figure 2:
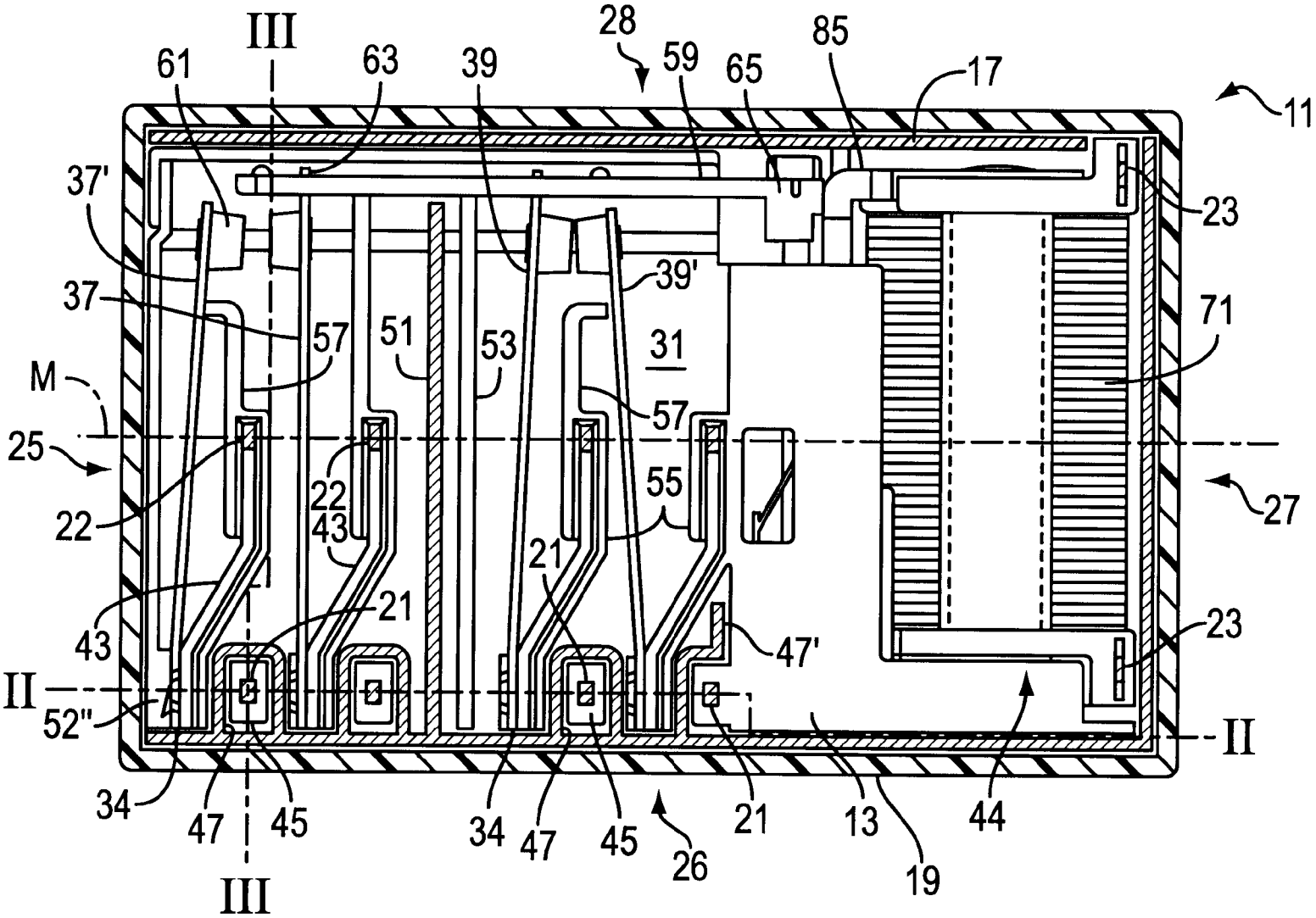

FIGS. 1 to 5 relate to an exemplary embodiment 11. The relay 11 will be described in what follows first by means of FIGS. 1 and 2 together. FIG. 1 shows a relay 11 in a view from the top. The plug connectors are covered, since they are arranged on the back. Accordingly, the relay 11 can be plugged in the viewing direction. The relay 11 looks as represented in FIG. 2 from the direction of the bottom, i.e., in the opposite direction from FIG. 1, or respectively from the direction of the back with the plug connectors, which is not visible in FIG. 1. However, the bottom is not represented in FIG. 2, or respectively a section between the bottom and the support element 13 is represented. The elements connected with the bottom element and the plug connectors which are passed through the bottom, are shown in a sectional view.

Figure 5:
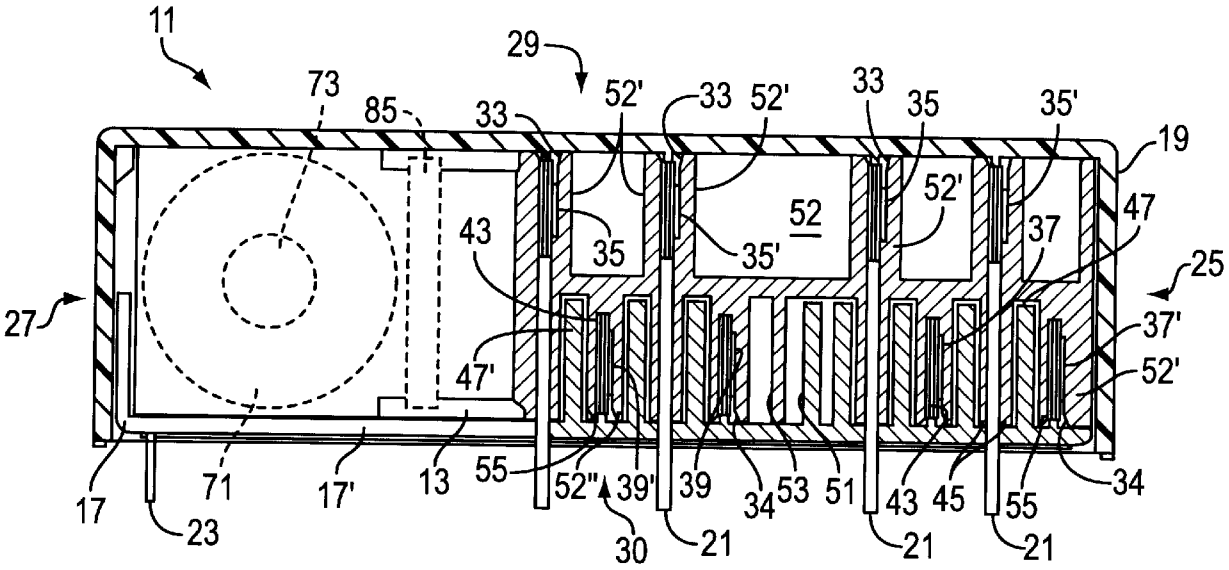
Figure 6:
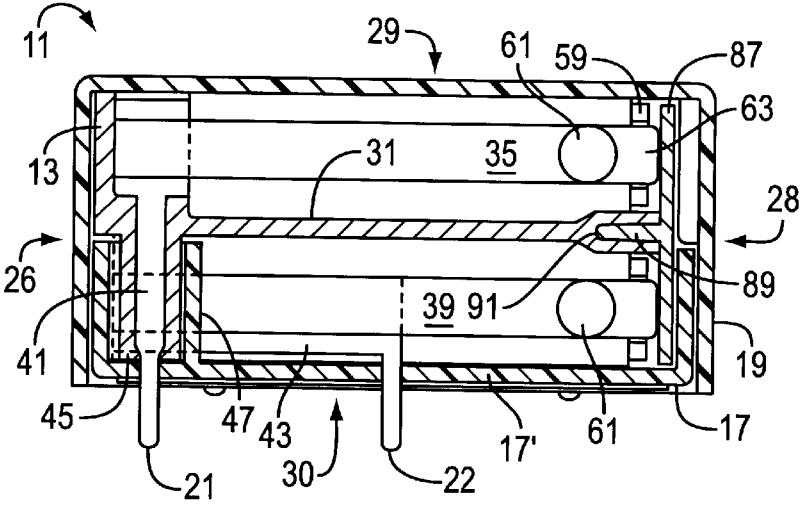

The relay includes a support element 13 and the elements fastened thereon, and a housing made of the bottom element 17 and the cover 19. The housing encloses all remaining elements of the relay, with the exception of the plug connectors 21, 22, 23. The cover 19 encloses the encompassed sides 25, 26, 27, 28 and the cover side 29 (FIGS. 5 and 6). The bottom element 17 covers the bottom side 30 (FIGS. 5 and 6), and on the sides 26, 27, 28 extends under the cover 19. The cover 19 and the bottom element 17 are latched together in this overlapping area.

The support element 13 forms a central partition 31 parallel with the bottom side 30 and the cover side 29. Clamping grooves 33 and 34 have been formed vertically in respect to this near the side 26 on both sides of the partition 31, into which contact springs 35, 35', 37, 37', 39, 39' have been placed. Respectively two contact springs 35/35', 37/37' and 39/39' together constitute one contact unit. The clamping grooves 33 are offset in respect to the clamping grooves 34 by approximately half the distance between the contact springs constituting a contact unit. Thus, from the side 25 there is a greater distance to the contact spring 35' than to the contact spring 37'. The distances between the contact springs 35, 35' on the cover side of the partition 31, however, are equal to the corresponding distances between the contact springs 37', 37, or respectively 39,39' on the bottom side of the partition 31. Each of the contact springs 35, 35', 37,37', 39, 39' has been respectively riveted to a connecting element 41, 43, which has been formed into a plug connector 21, 22.

The connecting elements 41 are passed vertically in respect to the contact springs 35, 35' through the partition 31 and between the contact springs 37, 37', 39,39', or respectively between the contact spring 39' and the actuating member 44. So that the distances between the electrically conductive elements of the contact units 35/35', 37/37', 39/39' can be sufficiently large, and yet the construction as compact as possible, the leakage and air paths have been extended in a labyrinthine manner. For this purpose a collar 45, which is connected with the partition 31, has been formed on the support element 13 around the connecting elements 41, which itself is enclosed by a collar 47, 47' formed on the bottom element 17. The leakage and air path, for example from the spring 37' to the adjoining plug connector 21, extends from the cover 19 to the partition 31 and around the collar 47 back to the cover 19.

The connecting elements 43 are bent off in a flat Z-line. Transversely in respect to the contact spring (height of the Z-line), the distance between the two ends of the connecting element 43 corresponds to the offset of the contact units 35/35' in relation to the contact units 37/37', or respectively 39/39'. Because of this the plug connector 22 comes approximately between the contact springs 37 and 37', or respectively 39 and 39'. The distance between the two ends of the connecting element 43 parallel with the contact springs (width of the Z-line) corresponds approximately to half the length of the contact springs 35, 35', 37, 37', 39, 39'.

Because of these offsets in the connecting elements 43, gets closer to the contact spring 39 than the distance rules for a so-called safe separation prescribe between the contact spring 37 and 39 the plug connector 22. But so that the leakage and air paths still can have the desired length, a separating wall 51, or respectively 53, and a circumferential wall 55 have respectively been formed on the bottom element 17 and on the partition 31 between these electrically conductive elements 43, 22 and 39 around the connecting element 43. The circumferential wall 55, which is provided with each connecting element 43, in addition provides a support of the latter and respectively constitutes a component of the separating wall 57 between the two contact springs of a contact element. Together with the element 52", the circumferential wall 55 constitutes the clamping groove 34.

The contact springs 35, 36, 39, which are guided by slide arms 59, differ from the contact springs 35', 37', 39' by a spring element 63 projecting past the small contact head 61, with which they are inserted into a slit in a slide arm 59. Together with a strip 65, two slide arms 59 constitute a slide. The partition 31 is arranged in a slit between the slide arms 59. The strip 65 has a depression, which is engaged by the actuating lever 67 of the tilting armature 69 of the electromagnet 44.

During operation, a magnetic field is built up in the core 73 by means of a current flowing in the coil 71. By means of this the tilting armature 69 is attracted to the core 73, so that the actuating lever 67 is tilted away from the coil 71 and displaces the slide 59, 65. The contact springs 35, 37, 39, which are inserted into the slide 59, 65 with a spring element 63 projecting past the small contact head 61, are moved with the slide arms 59 on their end on the contact side against the contact springs 35', 37', or respectively away from the contact spring 39'. By means of this, three contacts are closed and one contact is opened. If the current flow in the coil is interrupted, the tilting armature falls back out of the contact springs 35, 37, 39 under the effect of the spring force and the contacts 35/35' and 37/37' are opened, while the contact 39/39' is closed.

Figure 3:
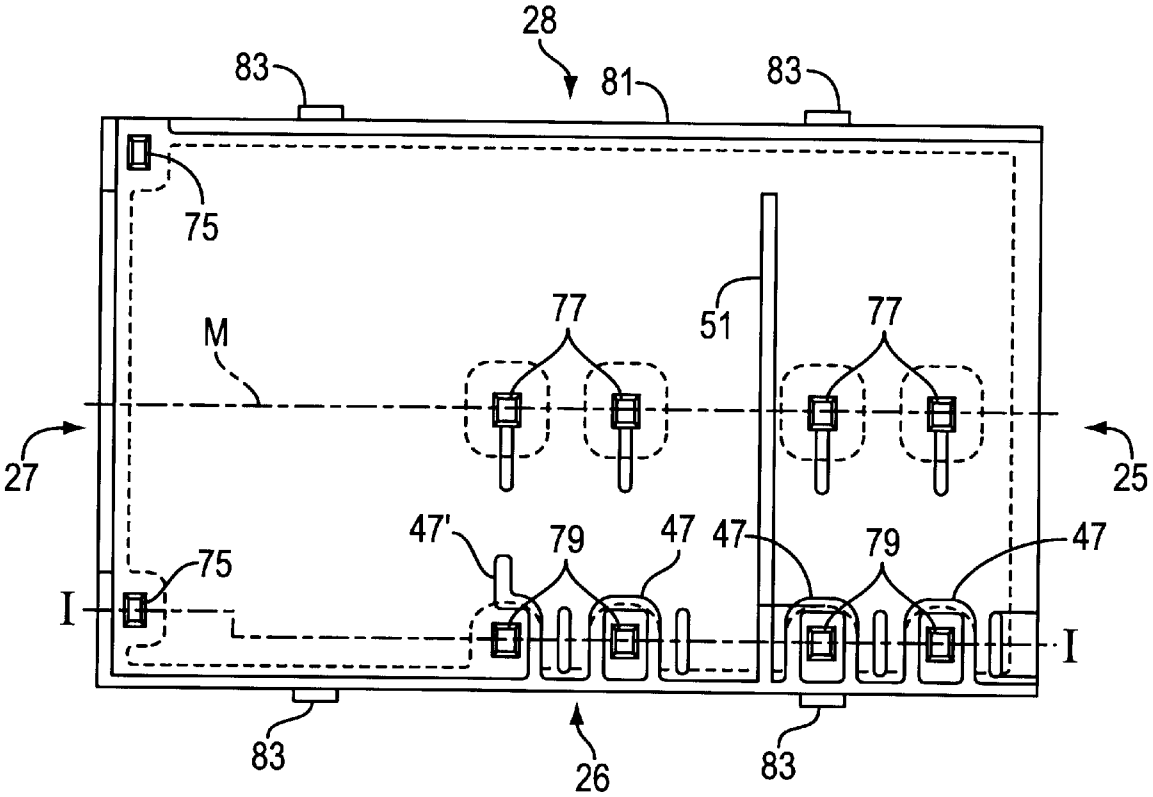
Figure 4:
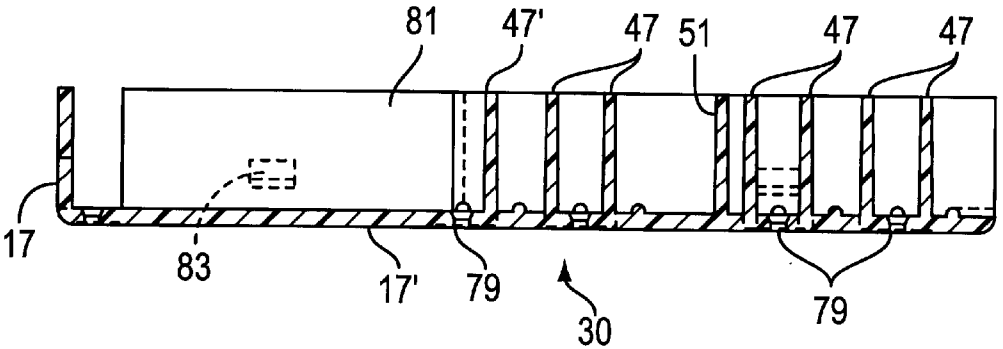

FIGS. 3 and 4 represent a plan view of the bottom element 17 from the interior and a sectional view along the line I—I. The arrangement of the plug connectors can be seen in the plan view. On the left are the two openings 75 for the plug connectors 23 of the electromagnet 44. The two openings 77 for the plug connectors 22 of the contacts units 37/37' and 39/39' near the bottom lie respectively next to each other on the centerline M. The openings 79, through which the pairs of plug connectors 21 of the contact units 35/35' remote from the bottom can be passed, are also arranged in pairs at the lower edge. The collars 47 for extending the leakage and air paths have a height corresponding to the structural height of the relay between the bottom 17' of the bottom element 17 and the partition 31. Protruding projections 83 have been formed on the wall 81 projecting from the bottom 17' on the sides 28 and 26, which snap into recesses in the cover 19.

FIGS. 5 and 6 represent two cross-sectional views extending vertically in respect to each other of the relay, namely FIG. 5 along the line II—II and FIG. 6 along the line III—III in FIGS. 1 and 2. The electromagnet 44 with the core 73 and the coil 71 is represented in dashed lines on the left in FIG. 6. It can also be seen that the yoke 85 of the electromagnet 44 has been inserted into a groove in the support element 13. The entire actuating element 44 can be inserted from the side 28 (see FIGS. 1, 2, 6) into the support element 13. It is also obvious that the contact units 35/35', which are arranged directly underneath the transparent cover 19, are offset in respect to the contact units 37/37' and 39/39', which are arranged at the bottom of the partition, by approximately half the distance between two contact springs of a contact unit. Moreover, the labyrinthine path extensions are represented by means of the separating walls 53 and 51 and by means of the collars 45, 47 and the elements 52" and 55 constituting the clamping grooves 34.

FIG. 6 shows the same path extension through the two collars 45 and 47 inserted into each other at the plug connectors 21 in a simplified cross-sectional view. An inner collar 45 is arranged on the support element 13, and an outer collar 47 on the bottom element 17. The air and leakage path extends from the bottom 17' to the partition 31, and from there again in the direction toward the bottom as far as the electrically conductive element 39. Added to this are the wall thicknesses of the collars 45, 47 and the distance between the collar 47 and the electrically conductive element 39. In addition to this, the labyrinthine path extension between the contact ends, which are movable by means of the slides 59, 65, are represented around the edge on the slide side of the partition 31. The slide 59, 65 is kept in engagement with the contact springs 35, 37, 39 by means of a cover 87. A cradle 89 arranged in the cover 87 is inserted into a groove 91 formed in the partition 31.

Figure 7:
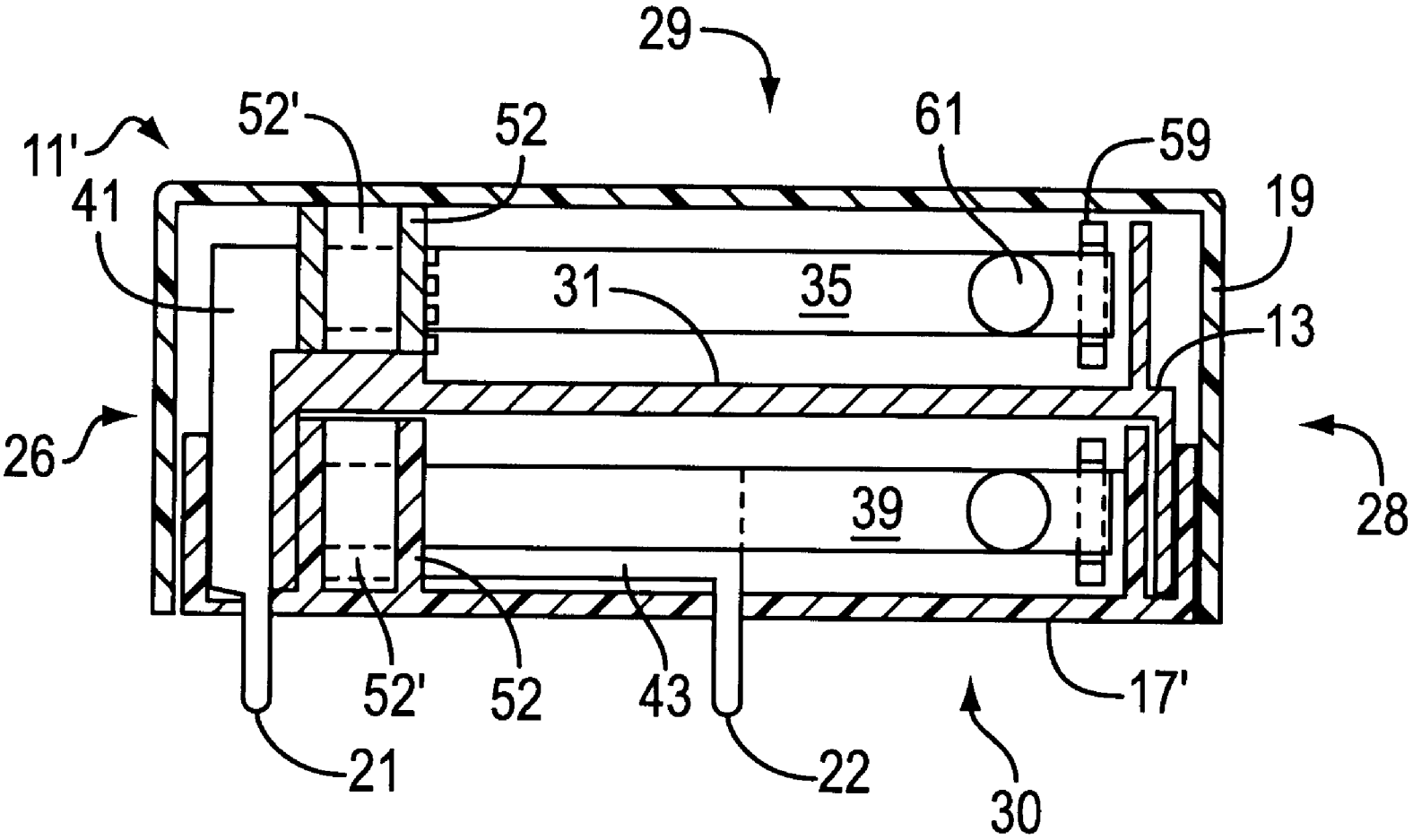
Figure 8:
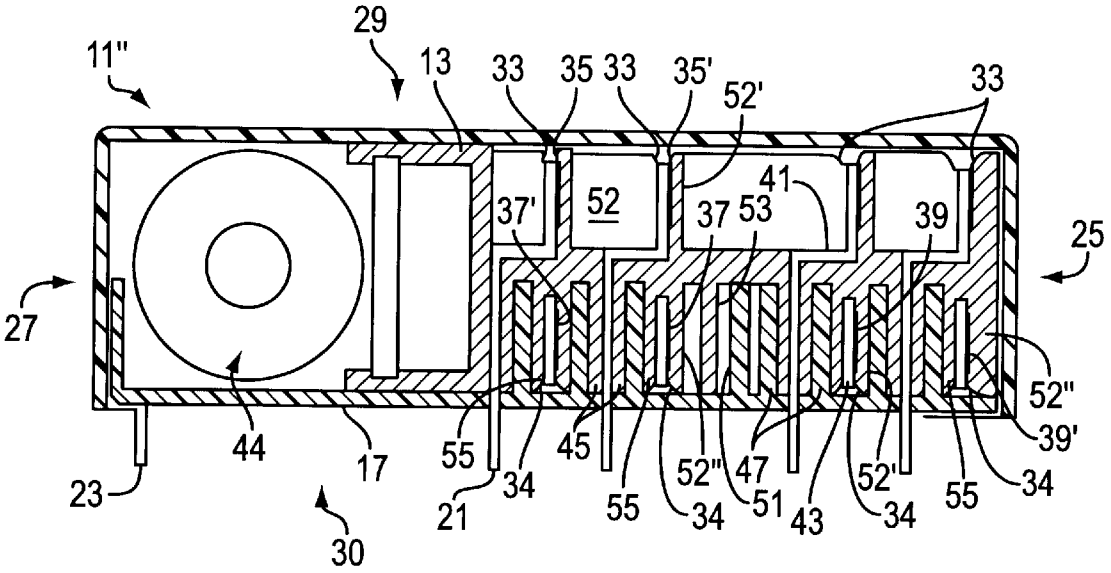
Figure 9:
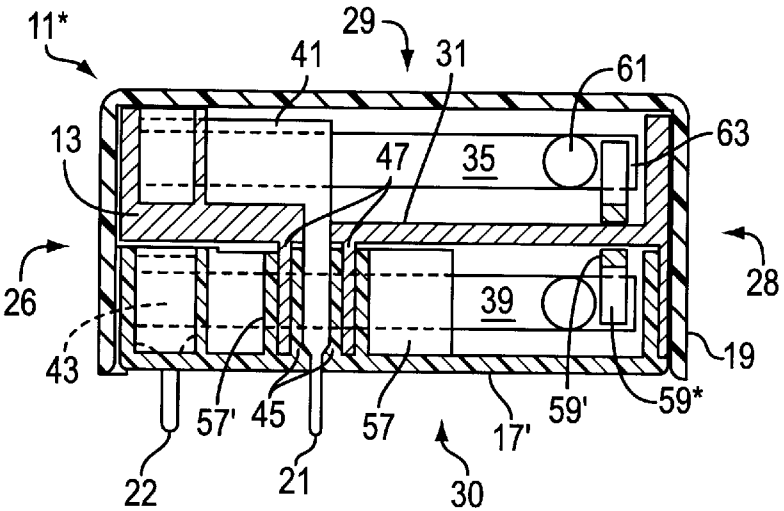

FIGS. 7 to 9 show three variations of the exemplary embodiment described above, wherein the corresponding elements are indicated by the same numerals in spite of different construction or shaping. FIG. 7 represents a cross section through a relay 11', wherein the connecting element 41 of the contact spring on the cover side with the plug connector 21 is conducted around the partition 31. The plug connector 22 of the contact spring 39 on the bottom side is arranged offset in the direction toward the contact head 61. Furthermore, the contact unit 39/39' arranged on the bottom side is fastened in the bottom element 17, and the contact unit 35/35' is fastened in the support element 13 with the partition 31. The support element 13 and the bottom element 17 have been inserted into each other.

FIG. 8 represents a variation 11" of a relay with Z-shaped connecting elements 41. The contact units 35/35' and 37/37', or respectively 39/39' are arranged on both sides of the partition 31 in positions opposite each other. The connecting elements 41 have been inserted into a clamping groove 33 between the elements 52, 52', which extend vertically in respect to each other, of the support element 13. A labyrinth path between the electrically conductive elements of the different contact units 35/35' and 37/37', or respectively 39/39', has been provided in the portion of the relay close to the bottom by means of the collars 45, 47 and the elements 52" and 55 constituting the clamping groove 34.

A relay 11* is represented in FIG. 9, wherein the plug connector 21 of the contact unit 35/35' arranged at the cover side has been passed though the partition 31 and is offset in respect to the contact head 61, and the plug connector 22 of the contact unit 39/39' on the bottom side is passed at the foot of the partition 31 directly through the bottom 17' of the bottom element 17. In this case the bottom element 17 supports the contact units 37/37', 39/39' on the bottom side. Accordingly, the inner collar 45 is arranged on the bottom element 17 and the outer collar 47 on the partition 31. To extend the air and leakage paths, the separating wall 57 has been extended around the collars 45, 47 as the third wall 57'. The slide arm 59' is designed as a rake. The tines 59* of the rake 59' are in engagement with the contact spring ends 63.

In summation it can be stated that a very compact relay has been achieved by offsetting the connecting element 41 of the contact units 35/35' arranged on the cover side of the partition 31 in relation to the contact units 37/37', 39/39' arranged at the bottom side, and the passage of the connecting elements 41 to the plug connectors 21 through the partition 31 and between the electrically conductive element 43, 37/37', 39/39' arranged at the bottom side. Thanks to the offset of the plug connectors 22 with the connecting element 43 on the centerline M, a very large distance, which meets all minimal requirements for a safe separation of all potentials, has been achieved between the plug connectors 21, 22. Labyrinthine paths for air and leakage paths have been created in the interior of the relay by means of the separating walls 51, 52, 52', 53, 55, covers 87, 89 and collars 45, 47, which also meet these requirements.

It will be appreciated by those skilled in the art that the present invention can be embodied in other specific forms without departing from the spirit or essential character thereof. The presently disclosed embodiments are therefore considered in all respects to be illustrative and not restrictive. The scope of the invention is indicated by the appended claims rather than the foregoing description and all changes which come within the meaning and range of equivalents thereof are intended to be embraced therein.

What is claimed is:

1. A relay comprising:

a. an electrically insulating means having a planar partition defining a first and a second side of said insulating means;

b. at least one contact unit fixed to each of the first and second sides, each contact unit having at least two contact members with each member having two ends wherein the first end is a contact end and a second end, opposite said first end, is connected to an elongated plug connector for enabling said relay to be plugged in, at least one of said contact members being an elongated contact spring fixed to the insulating means on said second end wherein a longitudinal axis of said contact spring is substantially parallel to the plane of the partition, the contact end of the contact spring being movable parallel to the plane of the partition and movable perpendicular to the longitudinal axis of the contact spring;

c. an actuating member for facilitating movement of the contact end of the contact spring, said movement resulting in making or breaking a contact between the contact ends of the contact members; and d. a plurality of plug connectors, wherein a first portion of said plurality of plug connectors is provided for plugging in the relay and is arranged on the first side proximal to the second end of the contact spring, a longitudinal axis of said first portion of plug connectors being arranged perpendicular relative to the planar partition in order for said first portion of plug connectors to be plugged in a perpendicular direction with respect to the planar partition; and a remaining portion of the plug connectors is located on the second side offset a first predetermined distance from the first portion of plug connectors in a direction towards the first end of the contact spring, and is connected to contact members located on the second side by connecting elements which bridge the first predetermined distance, said second portion being arranged at a second predetermined distance from the contact spring in a direction parallel to the plane of the partition, and a being arranged perpendicular to the longitudinal axis of the contact spring to provide a free movement of the contact spring when the contact end of the contact spring is moved by the actuating member.

2. The relay in accordance with claim 1, wherein the connecting elements passed through the partition from the contact members on one side of the partition to the associated plug connectors on another side of the partition are passed to at least one of:

the contact members arranged on the other side of the partition and electrically conductive elements.

3. The relay in accordance with claim 1, wherein a contact unit on one side of the partition is arranged with respect to a contact unit on the other side of the partition parallel with the planar partition and offset substantially vertically with respect to a length of the contact spring.

4. The relay in accordance with claim 1, wherein the plug connectors arranged at a fastened end of the contact spring pass through the partition.

5. The relay in accordance with claim 1, further comprising:

a housing, which induces a cover and a bottom element, said housing enclosing the contact units, the partition and the actuating member, wherein a bottom of the bottom element is arranged parallel with the planar partition and has openings for the plug connectors, wherein the connecting elements that pass through the partition are at least partially surrounded near the bottom of the planar partition by a collar connected with the planar partition and a collar formed on the bottom element, one of said collars being arranged around the other of said collars, so that leakage and air paths between the connecting elements connected with the contact members of the one side and elements connected with the contact members of the another side have a defined value.

6. The relay in accordance with claim 1, wherein the contact spring is in engagement with a slide, said slide being moved by means of the actuating member, the slide having two elongated small plates, separated by a slit and arranged on a same level on a strip, the strip being in contact with the actuating member and the planar partition being arranged vertically with respect to the small plates in the slit; and wherein further a cover, T-shaped in cross section, is arranged with a transverse face parallel with the small plates between the small plates and the housing, and inserted with a cradle vertically with respect to the transverse face in a groove in the planar partition, so that the small plates are maintained in their position in which they are engaged with the contact spring and wherein an air and leakage path between the contact units separated by the planar partition has a defined size.

7. The relay in accordance with claim 1, wherein the actuating member is an electromagnet with a coil around a core, wherein one plug connector for the coil, which is plugged vertically with respect to the partition, is arranged at two ends of the coil.

8. The relay in accordance with claim 1, wherein the contact units on both sides of the partition are fastened on at least one of the partition, and on a support element constituting the partition.

9. The relay in accordance with claim 8, wherein the actuating member can be plugged into the support element.

10. The relay in accordance with claim 1, wherein the actuating member is an electromagnet having a tilting armature, a core of said electromagnetic being aligned substantially parallel with the contact spring, and wherein a tilt axis of the tilting armature is arranged at a pole which is located opposite a pole close to the movable contact ends of the contact springs.

11. The relay in accordance with claim 1, wherein said plug connectors of the contact members on the second side of the partition are offset from the plug connectors at half the length of the contact spring.

12. A relay comprising:

a. an electrically insulating means having a planar partition defining a first and a second side of said insulating means;

b. at least one contact unit fixed to each of the first and second sides, each contact unit having at least two contact members with each member having two ends wherein the first end is a contact end and a second end, opposite said first end, is connected to an elongated plug connector for enabling said relay to be plugged in, at least one of said contact members being an elongated contact spring fixed to the insulating means on said second end wherein a longitudinal axis of said contact spring is substantially parallel to the plane of the partition, the contact end of the contact spring being movable parallel to the plane of the partition and movable perpendicular to the longitudinal axis of the contact spring;

c. an actuating member for facilitating movement of the contact end of the contact spring, said movement resulting in making or breaking a contact between the contact ends of the contact members;

d. a plurality of plug connectors, wherein a first portion of said plurality of plug connectors is provided for plugging in the relay and is arranged on the first side, a longitudinal axis of said first portion of plug connectors being arranged perpendicular relative to the planar partition in order for said first portion of plug connectors to be plugged in a direction perpendicular with respect to the planar partition; and e. connecting elements which connect the plug connectors on the first side to contact members on the second side through the partition.

* * * * *